US007077338B1

(12) United States Patent
Williamson

(10) Patent No.: US 7,077,338 B1
(45) Date of Patent: Jul. 18, 2006

(54) BOAT MISTING SYSTEM

(75) Inventor: Richard C. Williamson, La Luz, NM (US)

(73) Assignee: Richard Clark Williamson, La Luz, NM (US)

( * ) Notice: Subject to any disclaimer, the term of this patent is extended or adjusted under 35 U.S.C. 154(b) by 408 days.

(21) Appl. No.: 10/602,523

(22) Filed: Jun. 24, 2003

(51) Int. Cl.
*B05B 15/10* (2006.01)

(52) U.S. Cl. ..... 239/207; 239/67; 239/266; 239/289; 239/550; 239/565; 239/575; 239/587.4; 239/587.5; 114/343

(58) Field of Classification Search ..... 239/67, 239/70, 200, 201, 207, 208, 1, 266–269, 239/279, 373, 513, 514, 536, 550, 565, 575, 239/587.1, DIG. 23, 587.4, 587.5, 289; 114/343, 114/361
See application file for complete search history.

(56) References Cited

U.S. PATENT DOCUMENTS 4,788,791 A 12/1988 Sprung
5,217,161 A 6/1993 Souza
5,330,104 A 7/1994 Marcus
5,611,487 A * 3/1997 Hood ..... 239/373
5,628,273 A 5/1997 Crouse, II
5,975,423 A * 11/1999 Rice et al. ..... 239/1
6,081,944 A 7/2000 Edwards
6,175,969 B1 1/2001 Edwards
6,263,826 B1 * 7/2001 Key ..... 114/343
6,598,806 B1 * 7/2003 Phipps ..... 114/361
6,857,583 B1 * 2/2005 Attar ..... 239/289

* cited by examiner

*Primary Examiner*—Steven J. Ganey

(57) ABSTRACT

A boat misting system for cooling occupants of a boat or houseboat with a very fine aerosolized water spray is described. The water for the system is taken from the body of water upon which the boat floats so that a virtually limitless amount of misting water is available. The boat misting system is aesthetically pleasing because the plumbing components are concealed below the deck or within the hull of a boat. If desired, extension hoses may be used to equip a boat canopy with a portion of the misting system. The misting spray may be applied continuously or cycled intermittently using a timer.

17 Claims, 5 Drawing Sheets

BOAT MISTING SYSTEM

FIELD OF THE INVENTION

The present invention relates to a system for pumping water from a lake, river, or other body of water and aerosolizing the water into a cooling mist for the occupants of a boat.

BACKGROUND OF THE INVENTION

Several misting devices for climate control are known in the art. Sprung, in U.S. Pat. No. 4,788,791, describes a misting system for controlling the build-up of heat within greenhouses. Marcus, U.S. Pat. No. 5,330,104, discloses a portable misting system enclosed in a food and beverage cooler. Edwards, U.S. Pat. No. 6,175,969 B1, and Crouse, II, U.S. Pat. No. 5,628,273, both disclose boat misting systems designed to cool boat occupants. However, Edwards' invention requires an on-board water tank and Crouse's invention is directed only toward flexible tubing hung from a canopy. Neither inventor suggests that the plumbing of a misting system can be concealed below deck or within the hull of a boat. Furthermore, the prior art makes no mention of an adjustable angle relative to the horizon head spray nozzle or of timer controlled misting cycles.

SUMMARY OF THE INVENTION

The primary aspect of the present invention is to provide an apparatus for producing a very fine water mist for cooling occupants of a boat or other water borne vessel. The apparatus draws water from a body of water and disperses it as an aerosolized mist over the deck portion of a boat through a plurality of spray nozzles.

Another aspect of the present invention is to provide spray nozzles that protrude from the boat hull and are each independently adjustable. The nozzle head spray angle and the pressure of the misting spray from each spray nozzle may be manually adjusted.

Another aspect of the present invention is to provide an aesthetically pleasing boat misting system wherein the plumbing components are concealed below a deck or within a hull of a boat.

Another aspect of the present invention is to provide quick disconnect points where hoses may be attached to the boat hull. The hoses would provide water to spray nozzles which may be attached to a boat canopy if desired.

Another aspect of the present invention is to provide a timer that allows for the cooling mist to be cycled on and off.

Other aspects of this invention will appear from the following description and appended claims reference being made to the accompanying drawings forming a part of this specification wherein like reference characters designate corresponding parts in the several views.

Before explaining the disclosed embodiment of the present invention in detail, it is to be understood that the invention is not limited in its application to the details of the particular arrangement shown, since the invention is capable of other embodiments. Also, the terminology used herein is for the purpose of description and not of limitation.

DETAILED DESCRIPTION OF THE DRAWINGS

Figure 1:
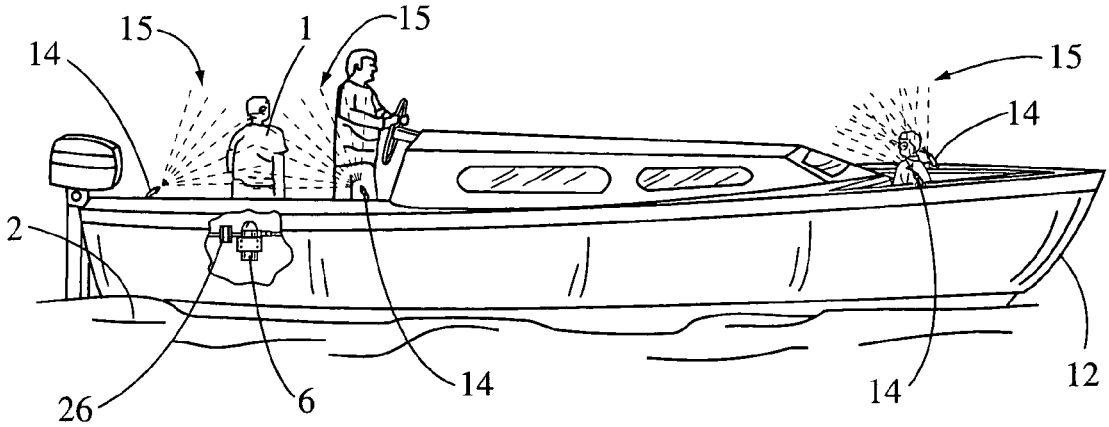
FIG. 1 is a side plan view of a boat equipped with the preferred embodiment of the boat misting system.
Figure 2:
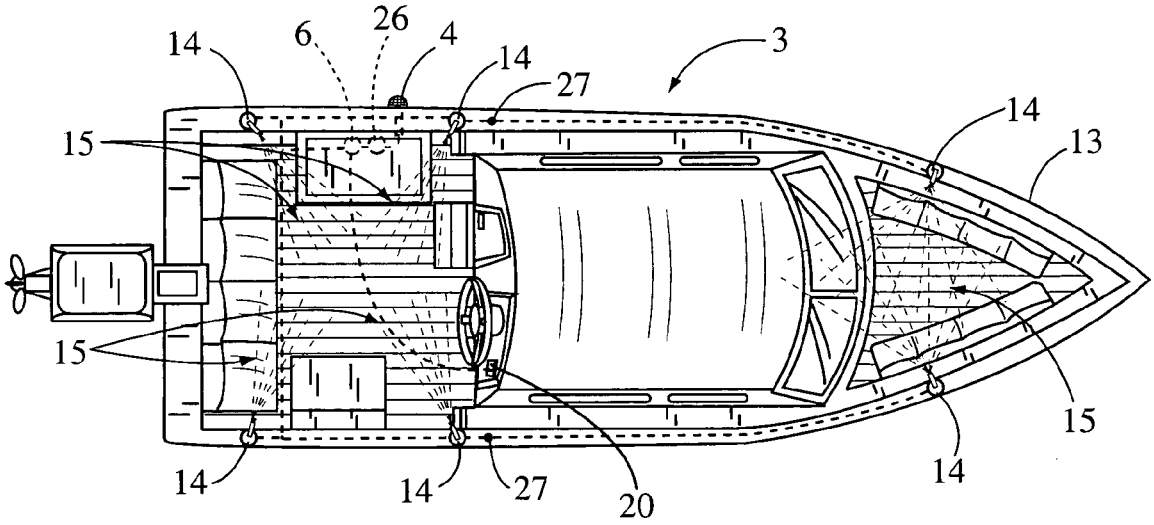
FIG. 2 is a top plan view of the preferred embodiment of the boat misting system shown in FIG. 1.
Figure 3:
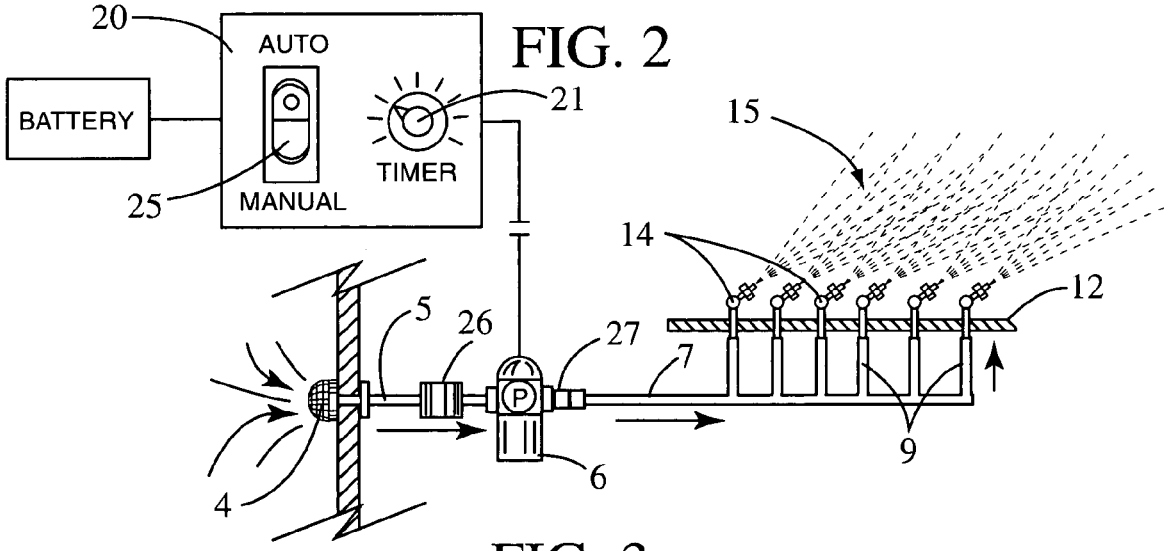
FIG. 3 is a schematic drawing showing the electronic components of the boat misting system, which draw water from a source and disperse it through a plurality of spray nozzles.

Referring now to the drawings, the preferred embodiment is shown in FIGS. 1–5. FIGS. 1 and 2 show the occupants 1 of a boat 13 being cooled by a misting spray 15. The misting spray 15 is produced when water (not shown) from a water source 2 enters the boat misting system 3 through a screened water inlet 4. The water inlet 4 is connected via supply piping 5 to a filter 26 and then to a pump 6. Pressurized water leaves the pump 6 through a supply outlet manifold 7.

Figure 4:
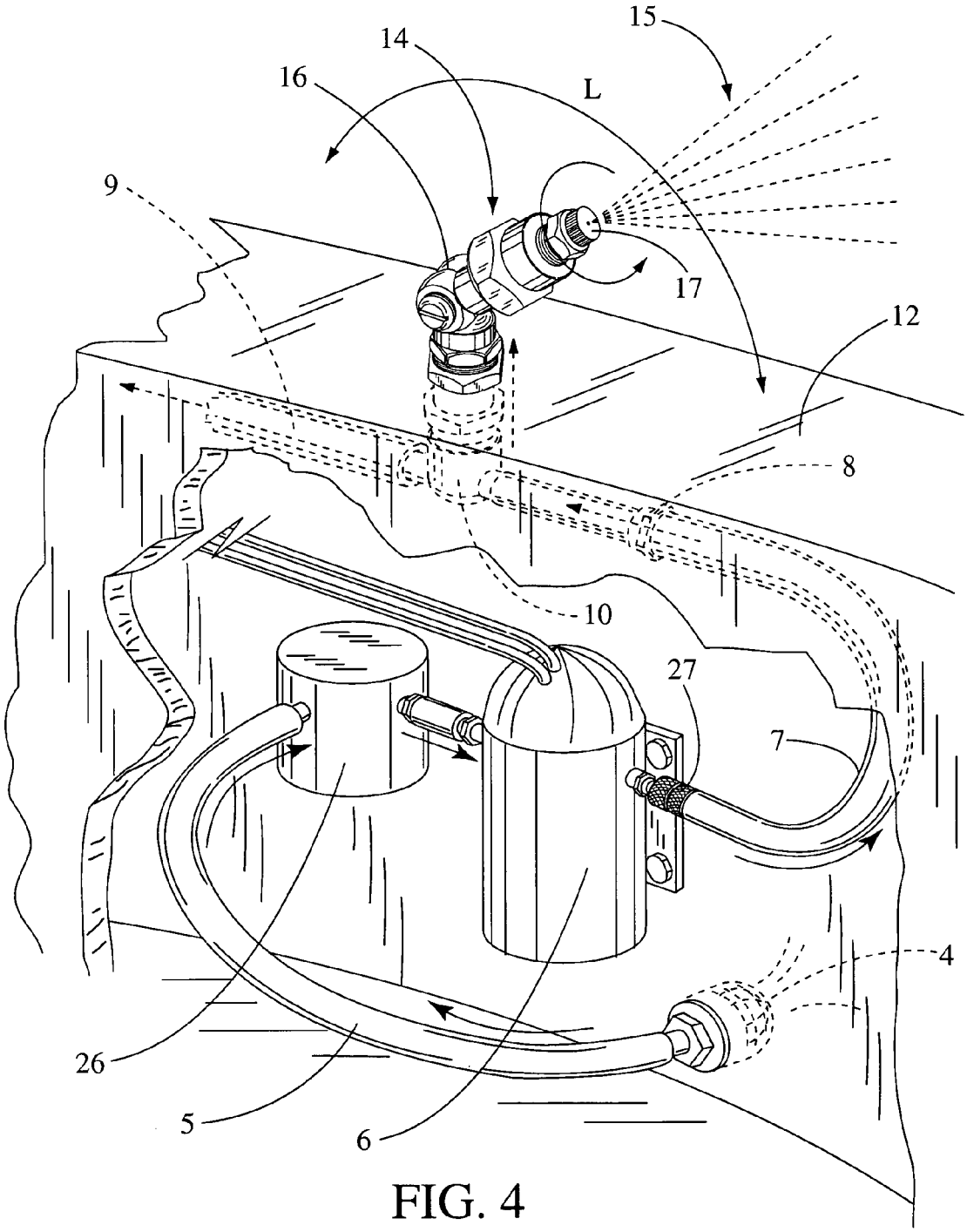
FIG. 4 is a cut away view of a boat hull showing the flow of water from an inlet to a spray nozzle.
Figure 5:
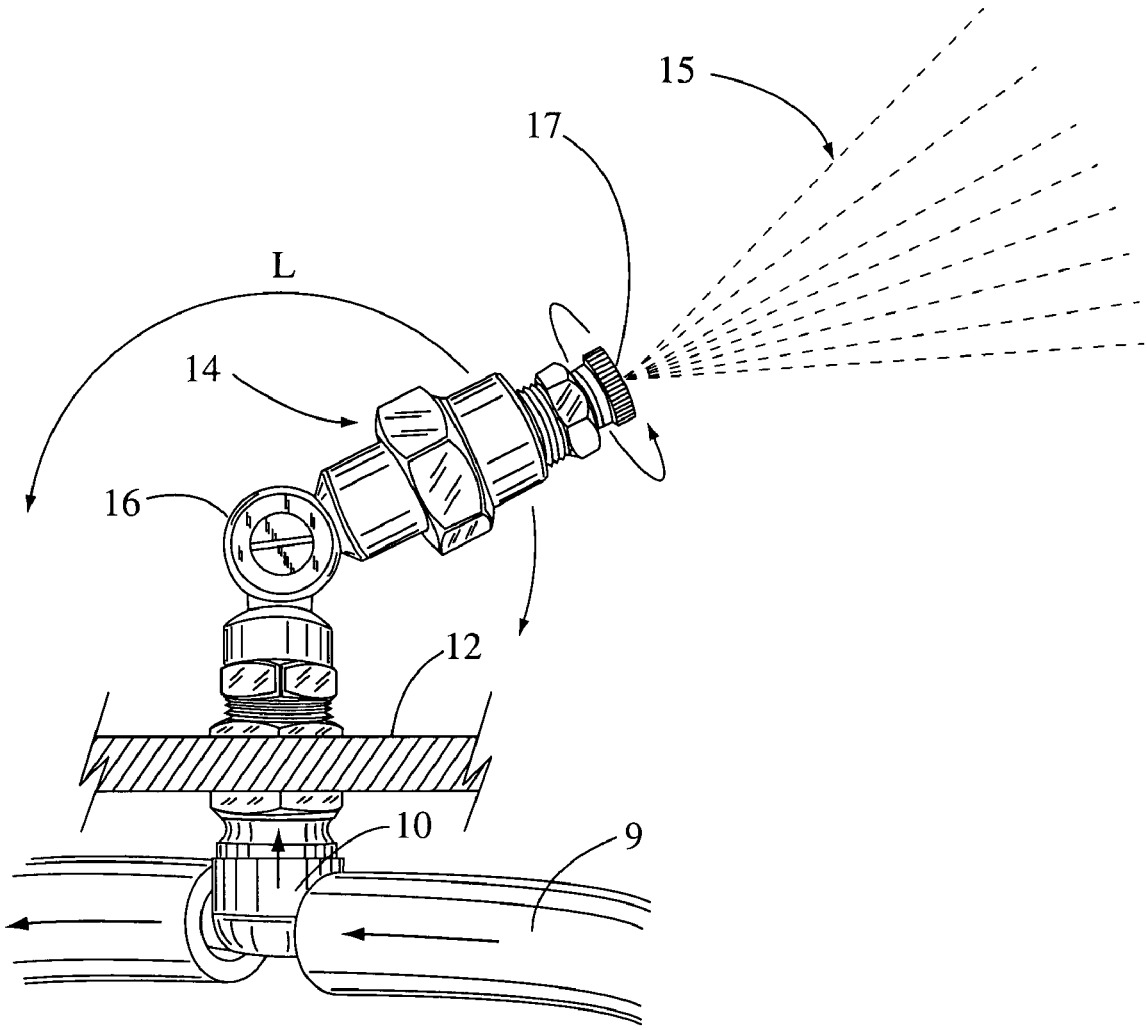
FIG. 5 shows the connection of a spray nozzle to the plumbing components, wherein the plumbing components are concealed within a boat hull.

Referring next to FIG. 4, the supply outlet manifold 7 moves the water through one or more reducers 8 before it enters a plurality of flexible supply lines 9. The supply lines 9 contain a multitude of fittings 10 in series. The plumbing components (4–10 and 26) are concealed below deck 11 or within a hull 12 of a boat 13. Spray nozzles 14 extend outside the hull 12 of the boat 13 from the fittings 10. Each spray nozzle 14 emits a misting spray 15. The longitudinal direction L and pressure of the misting spray 15 may be adjusted via a swivel joint 16 and a mist control tip 17, respectively.

Figure 6:
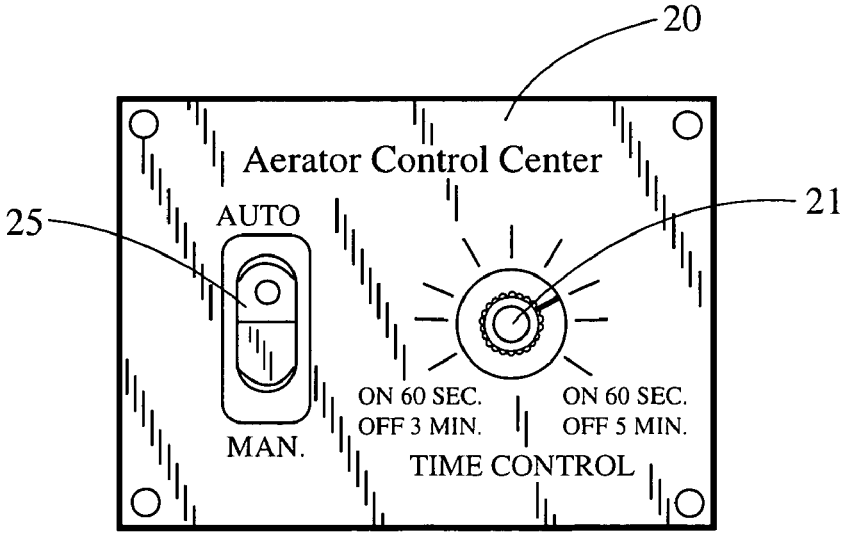
FIG. 6 is a front plan view of a control panel.

Referring next to FIG. 6, the misting system 3 is operated by a control panel 20, which is in electronic communication with the pump 6. The control panel may be comprised of an operation control switch 25 and a timer 21. The operation control switch 25 allows the user to choose a manual or automatic setting. The manual setting provides a constant misting spray until the operation control switch 25 is set back to a neutral position by the operator. The automatic setting works with the timer 21 to cycle the misting spray on 60 seconds, off 3–5 minutes. This cycle will continue until the operation control switch 25 is set to the neutral/off position by the operator.

Figure 7:
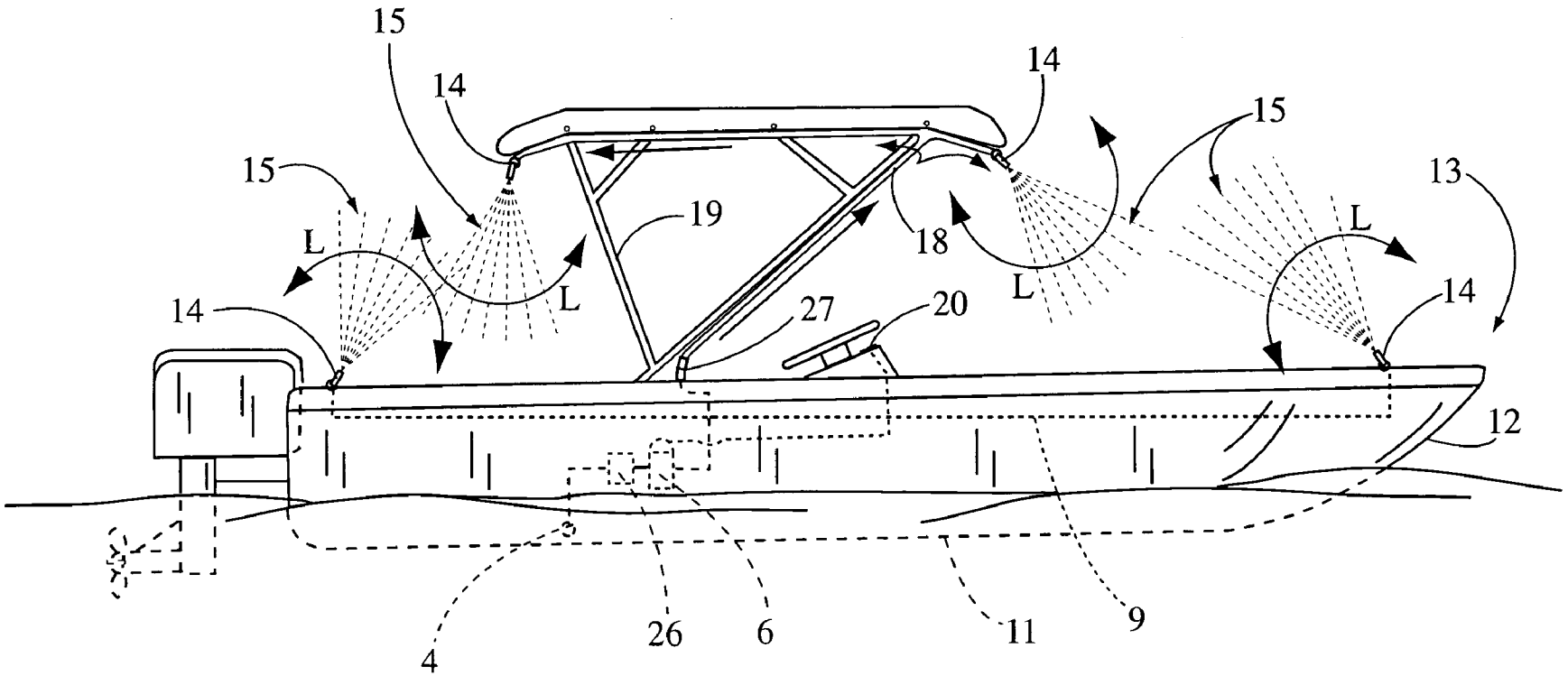
FIG. 7 shows a boat misting system with optional canopy mounting spray nozzles.

FIG. 7 shows an optional extension of the misting system 3 to a canopy frame 19 wherein quick disconnects 27 located near the attachment point of the canopy frame 19 to the boat 13 allow extension hoses 18 to be inserted between the fittings 10 and the spray nozzles 14.

Figure 8:
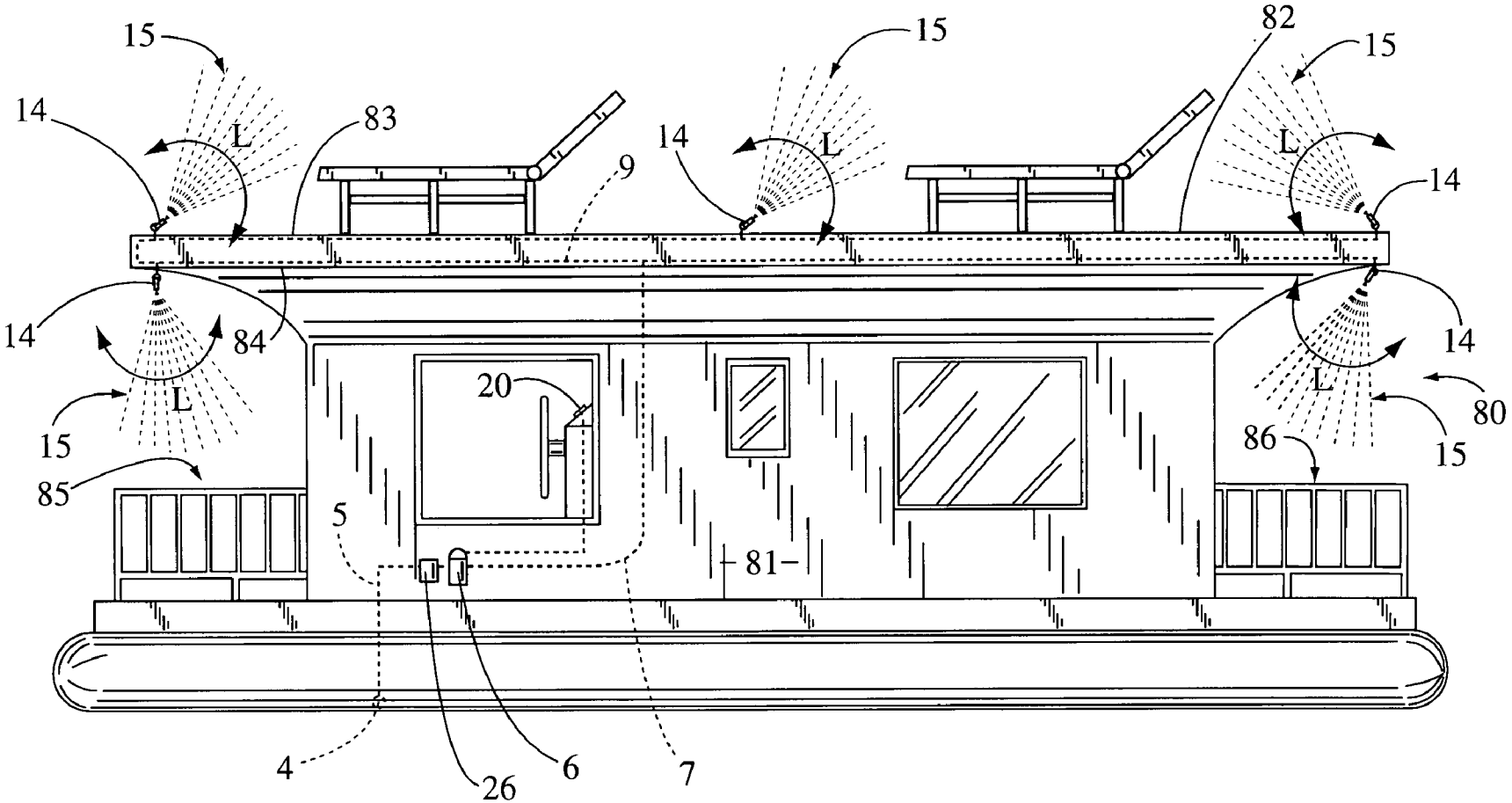
FIG. 8 shows a side plan view of a houseboat equipped with the boat misting system.

FIG. 8 shows the boat misting system 3 as it would be installed on a houseboat 80. The supply outlet manifold 7 is installed in the wall 81 of the houseboat 80 and the supply lines 9 are concealed within the roof 82 of the houseboat. The independently adjustable pressure and adjustable tilt angle spray nozzles 14 protrude from the rooftop 83 as well as depend from the roof bottom 84 into the deck areas 85,86.

The preferred components for the boat misting system described above include: a PVC supply outlet manifold, flexible poly-pipe supply line, a dc electric pump capable of producing 15 gpm at 60 psi, 180 degree brass swivel joints for adjusting spray nozzles with a 7 foot misting radius, a 12V pump control unit that may be operated manually or set to automatically turn on the misting system for 60 seconds with an adjustable off time of 3–5 minutes, and 12 gauge insulated copper wiring connecting the control panel and the pump.

Although the present invention has been described with reference to preferred embodiments, numerous modification and variations can be made and still the result will come within the scope of the invention. No limitation with respect to the specific embodiments disclosed herein is intended or should be inferred. Each apparatus embodiment described herein has numerous equivalents.

I claim:

1. A boat misting system comprising:

a screened water inlet for covering an opening in the side of a boat;

said screened water inlet positionable within a water source;

a filter connectable to said water inlet and concealable below a deck of the boat;

supply piping connectable to the inlet and the filter and concealable below the deck of the boat;

a water pump, connectable to said filter with said supply piping, for drawing water through said water inlet and said filter;

said water pump concealable below the deck of the boat;

said water pump connectable to a control panel;

a supply outlet manifold concealable below the deck and extendable from said water pump to a portion of the boat;

a plurality of supply lines connectable to said supply outlet manifold; and a plurality of independently adjustable pressure and adjustable tilt angle spray nozzles installable at intervals along said supply lines.

2. The boat misting system of claim 1, wherein each said spray nozzle has a swivel joint and a mist control tip.

3. The boat misting system of claim 1, wherein the control panel has a timer for cycling the pump.

4. The boat misting system of claim 1, wherein said supply lines are concealable within a hull of the boat.

5. The boat misting system of claim 1 further comprising a plurality of reducers for connecting said supply outlet manifold to said supply lines.

6. The boat misting system of claim 1 further comprising quick disconnects for attaching a length of extension tubing with a plurality of said spray nozzles for the purpose of extending a portion of said misting system to a canopy frame.

7. A boat misting system comprising:

a screened water inlet for covering an opening in the side of a boat;

said screened water inlet positionable within a water source;

a filter connectable to said water inlet and concealable below a deck of the boat;

supply piping connectable to the inlet and the filter and concealable below the deck of the boat;

a water pump, connectable to said filter with said supply piping, for drawing water through said water inlet and said filter;

said water pump concealable below the deck of the boat;

said water pump connectable to a control panel;

a supply outlet manifold concealable below the deck and extendable from said water pump to a portion of the boat;

a plurality of supply lines concealable in a boat hull and connectable to said supply outlet manifold; and a plurality of independently adjustable pressure and adjustable tilt angle spray nozzles protruding from the boat hull at intervals along said supply lines.

8. The boat misting system of claim 7, wherein each said spray nozzle has a swivel joint and a mist control tip.

9. The boat misting system of claim 7, wherein the control panel has a timer for cycling the pump.

10. The boat misting system of claim 7 further comprising quick disconnect means for attaching a length of extension tubing with a plurality of said spray nozzles for the purpose of extending a portion of said misting system to a canopy frame.

11. A boat misting system comprising:

a screened water inlet;

a filter concealed under a deck of a boat;

said filter connected to said water inlet;

supply piping connected to said filter and concealed under the deck of the boat;

a water pump concealed under the deck of the boat;

said water pump connected to said filter and in electronic communication with a control panel;

a supply outlet manifold extended from said water pump and concealed under the deck or within a hull of the boat;

a plurality of supply lines connected to said supply outlet manifold and concealed within the hull of the boat; and a plurality of independently adjustable pressure and adjustable tilt angle spray nozzles protruding from the boat hull at intervals along said supply lines.

12. Boat misting system of claim 11, wherein each said spray nozzle has a swivel joint and a mist control tip.

13. The boat misting system of claim 1, wherein the control panel has a timer for cycling the water pump.

14. The boat misting system of claim 11 further comprising quick disconnect means for attaching a length of extension tubing with a plurality of said spray nozzles for the purpose of extending a portion of said misting system to a canopy frame.

15. A boat misting system comprising:

a screened water inlet for covering an opening in the side of a boat;

said screened water inlet positionable within a water source;

a filter connectable to said water inlet and concealable within a wall of the boat;

supply piping connectable to the inlet and the filter and concealable below a deck and within the wall of the boat;

a water pump, connectable to said filter with said supply piping, for drawing water through said water inlet and said filter;

said water pump concealable within the wall of the boat;

said water pump connectable to a control panel;

a supply outlet manifold concealable within the wall and extendable from said water pump to a portion of the boat;

a plurality of supply lines concealable in a roof of the boat and connectable to said supply outlet manifold; and a plurality of independently adjustable pressure and adjustable tilt angle spray nozzles protruding from the boat roof at intervals along said supply lines.

16. The boat misting system of claim 15, wherein each said spray nozzle has a swivel joint and a mist control tip.

17. The boat misting system of claim 15, wherein the control panel has a timer for cycling the pump.

* * * * *